United States Patent [19]

Federighi, Sr.

[11] Patent Number: 5,000,063

[45] Date of Patent: Mar. 19, 1991

[54] BOTTLE STOPPER PULLER

[76] Inventor: George Federighi, Sr., 70 - 13th St., San Francisco, Calif. 94103

[21] Appl. No.: 488,986

[22] Filed: Mar. 5, 1990

[51] Int. Cl.[5] ..... B67B 7/06

[52] U.S. Cl. ..... 81/3.37; 81/3.44; 81/3.48

[58] Field of Search ..... 81/3.36, 3.37, 3.29, 81/3.4, 3.41, 3.44, 3.48

[56] References Cited

U.S. PATENT DOCUMENTS

| | | | |
|---|---|---|---|
| 4,063,483 | 12/1977 | Bozzo | 81/3.37 |
| 4,399,720 | 8/1983 | Cuppett | 81/3.37 |
| 4,527,450 | 7/1985 | Drosky | 81/3.37 |
| 4,750,391 | 6/1988 | Sweatt | 81/3.29 |
| 4,756,214 | 7/1988 | Valtri | 81/3.45 |
| 4,798,106 | 1/1989 | Foster | 81/3.29 |

*Primary Examiner*—Roscoe V. Parker, Jr.
*Attorney, Agent, or Firm*—Harris Zimmerman

[57] ABSTRACT

A stopper remover and piercing pin for champagne bottles, and the like, which has grasping jaws and a piercing pin on an operative shaft, wherein the operative shaft is moved by lever-driven gears inward toward the bottle to pierce the stopper and outward away from the bottle to remove the stopper.

14 Claims, 2 Drawing Sheets

BOTTLE STOPPER PULLER

BACKGROUND OF THE INVENTION

1. Field of the Invention

This invention pertains to a bottle opener that is particularly adapted to open champagne-type bottles, specifically those having hollow plastic stoppers or corks, as well as conventional solid corks. It includes a piercing pin to pierce the hollow stopper to release gas from the bottle before the stopper is pulled.

2. Description of the Related Art

The closest prior art known to the inventor is described in U. S. Pat. No. 4,750,391 which issued June 14, 1988 to Stanley I. Sweatt for an "Opener for Removing Champagne-Type Corks". That patent describes an apparatus having an annular base or ring, for surrounding the stopper and bottle opening, to be supported on a bottle flange. A pair of supports, with grooved jaw-guides therein, are upstanding from the base and substantially parallel to the axis of the base ring. They are attached to the base at opposite ends of a diameter of the base. A pair of levered gears are pivoted, substantially on the top end of the upstanding members, about substantially parallel axes perpendicular to the axis of the annular base. The upstanding members also support a sleeve which encloses an operative shaft with a rack gear thereon. Attached to the end of the operative shaft are a pair of grasping members or jaws for surrounding and extracting a stopper from a bottle. Each of the two jaws comprises a stopper-grasping hook, and the hooks are freely supported upon a common axle which is lifted and lowered by motion of the operative shaft. To prevent the hooks from turning about the axis of the shaft, they ride in channels on the upstanding supports. The apparatus has other features that are not germane to this application. Additional patents disclosing cork pullers include Bozzo, No. 4,063,473; Cuppett, No. 4,399,720; Drosky, No. 4,527,450; and Foster, No. 4,798,106.

SUMMARY OF THE INVENTION

The apparatus of the invention has a piercing pin on an operative shaft and a pair of opposed puller-grasping jaws which are driven up and down by the operative shaft. The operative shaft has a rack gear around its outer surface to engage two lever-operated segment gears. The shaft is slidable in and centered by a sleeve which has a pair of clevises, extending in radially opposite directions which are supported by two upstanding support rods from a base ring. The clevises are bent substantially ninety degrees at their upper end to form support axles for the segment gears. Movement of the levers and gears move the operative shaft upward and downward. The base ring is dimensioned to fit over the top of a champagne bottle, or the like, and rest on a peripheral rim found on such bottles. The internal opening is sized to clear typical bottle stoppers. Close conformity of the ends of the jaws to the stopper enhances the pulling of the stopper. The arcuate ends of the jaws embrace the stopper for a substantial portion of its circumferential extent, facilitating pulling, and reducing bearing stress and damage to the stopper.

The bottom end of the operative shaft carries a piercing pin for a hollow champagne stopper, or the like. Two jaws are pivoted relative to each other, and the pivot is suspended in an axially directed slot in the lower end of the puller shaft. The slot is sufficiently long to allow the stopper to be pierced by downward motion of the operative shaft to release gas from carbonated wines and the stopper to be pulled by upward motion of the operative shaft. The slot is sufficiently short to cause the jaws to spread until they hit a stop. That acts as a stop for the piercing pin.

Reversing the direction of travel of the operative shaft to an upward motion removes the piercing pin from the stopper. Further travel causes the jaws to grasp the stopper and remove it from the bottle.

It is therefore a feature and object of this invention to pierce and extract the stopper from a beverage bottle.

Another object of this invention is to provide a mechanical extractor for a cork or stopper, in which arcuate jaws extend along an undercut of the cork in order to physically engage and pull the cork free from the bottle.

It is a more specific feature and object of this invention to remove a stopper from a bottle of sparkling wine by first relieving the internal gas pressure in the bottle, and then withdrawing the stopper.

Other objects will become apparent from the following description taken together with the accompanying drawings.

DETAILED DESCRIPTION OF THE PREFERRED EMBODIMENT

Figure 1:
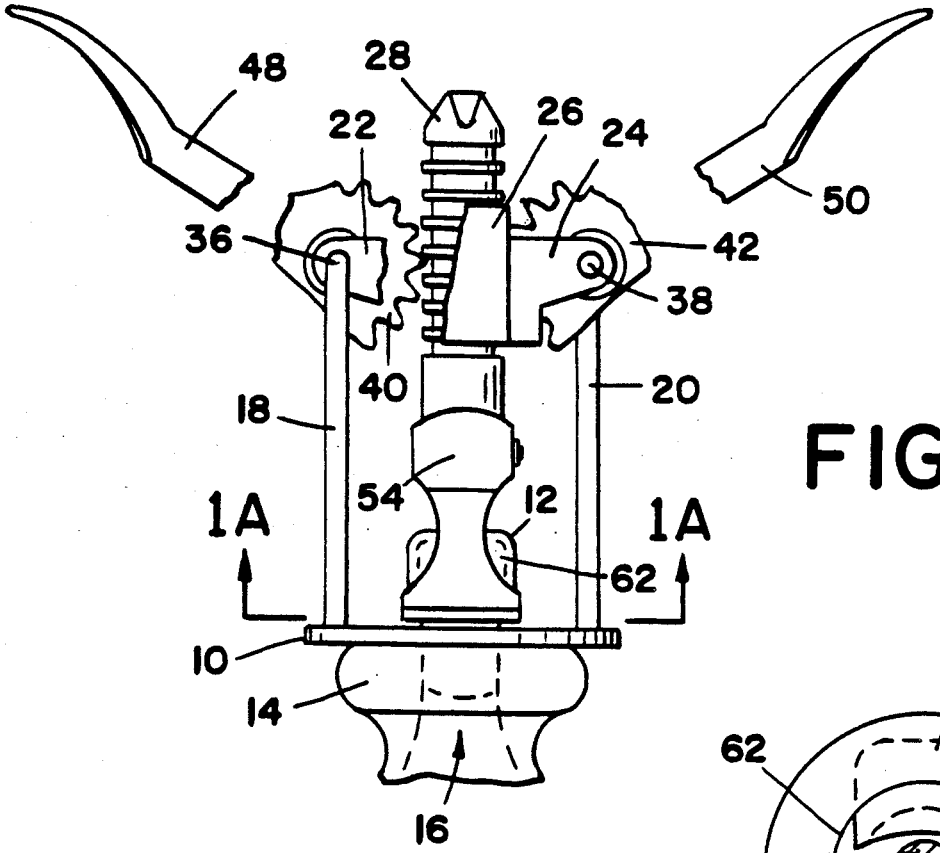
FIGS. 1 and 2 are profile and side views, respectively, of the apparatus of the invention in a position wherein the apparatus is neither piercing nor pulling the stopper.
Figure 1A:
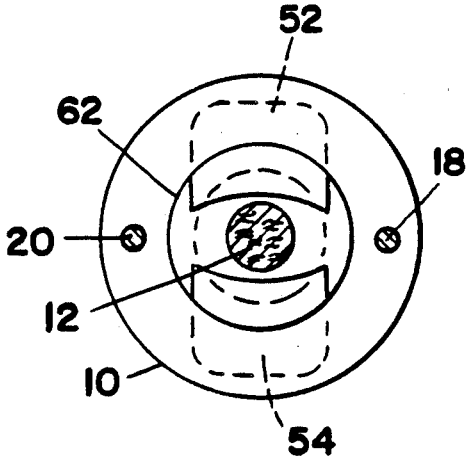
FIG. 1A is a view, partly in section, taken at 1A—1A in FIG. 1.

The apparatus has a base ring 10 which has an opening that is sufficiently large to fit over a stopper 12 and small enough to rest on a peripheral flange 14 of a bottle 16. Upstanding from the base ring 10 are two support rods 18 and 20 which support clevises 22, 24 which are attached to a central sleeve 26. The sleeve 26 supports an operative shaft 28 which is substantially aligned with the axis 30 of the bottle neck 32 and the base ring 10. On the outside of the operative shaft 28 is a rack gear 34. It is convenient to bend the support rods 18 and 20 as at 36 and 38 to penetrate the clevises 22, 24 and form axles for levered segment gears 40 and 42. The gears engage the rack gear 34 through a slot, such as slot 44 of FIG. 2, and they are hand-driven through levers and handles 48 and 50.

A pair of jaws 52, 54 are freely pivoted together on a pin 56. The pin 56 slides freely in an axially extending slot 58 near the bottom end of the operative shaft 28. The bottom edges of the jaws 52, 54 are preferably curved and define an arcuate edge, the better to fit the stopper 12 and bottle 16 contour.

On the bottom end of the operative shaft is a piercing pin 60. The slot 58 is sufficiently long to allow the piercing pin 60 to clear the stopper 12 both when the apparatus is placed on the bottle (in FIG. 2), and during the pulling operation (in FIG. 4).

The slot 58 is sufficiently short to push the jaws 52, 54, against the base ring 10 during the operation to cause the jaws to spread until they reach their limiting position. When the jaws 52, 54 no longer spread, the downward travel of the piercing pin is stopped. The individual jaws 52, 54 have a clearance at their upper end which allows them to open. When the jaws are opened wide, the edges of the clearance space move snugly against the shaft 28, and they can move no farther. The pivot 56 can then move downward no more, and the downward movements of the shaft 28 and the piercing pin 60 are stopped.

If the jaw pin 56 were fixed to the shaft 28, the piercing pin would not move out of the way to allow various sized stoppers to be inserted and pulled. Only a stopper of a very limited range of sizes wherein the piercing pin clears the stopper could be pulled. To pierce the stopper, the jaws must move out of the way. Without a slot, the piercing pin could not move so far without reaching its limiting position.

If the slot were too long, the operative shaft would need to travel extensively before it picked up the pivot 56 for the jaws 52, 54, and the entire apparatus would need to be longer, the gear would need to be larger to cause the shaft to travel the required extra distance within the limited travel of the levers 48 and 50.

Figure 2:
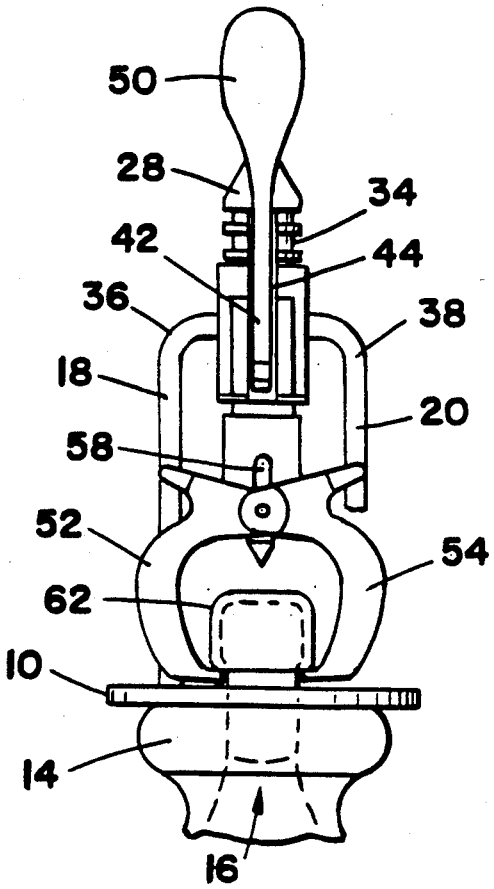
Figure 3:
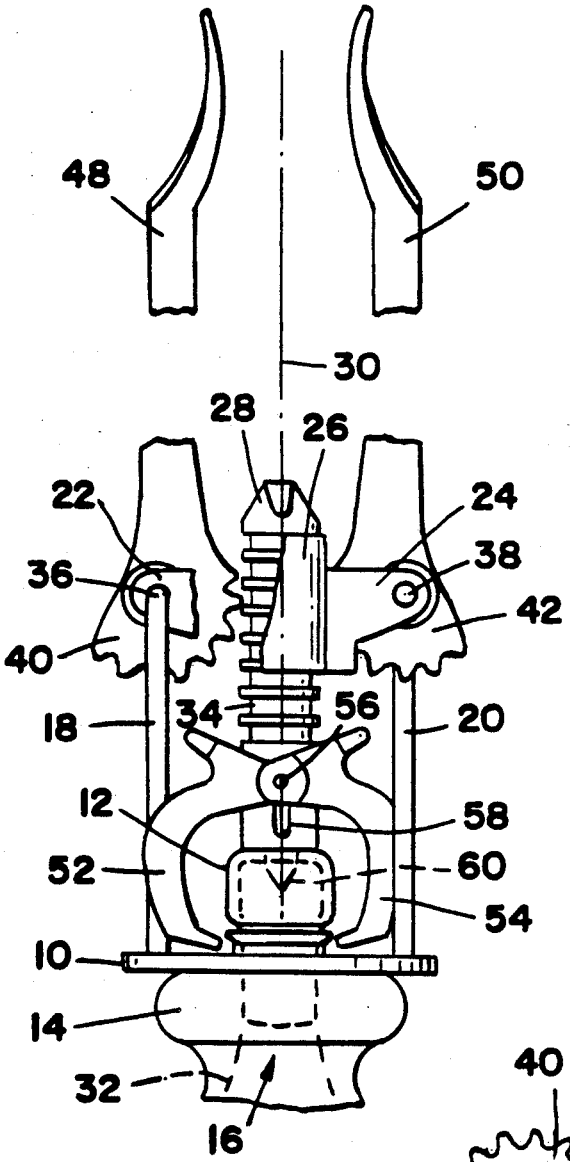
FIG. 3 is a profile view of the apparatus piercing a stopper.

In operation, one places the levers 48 and 50 in the approximate position shown in FIGS. 1 and 2 and places the support ring 10 over the cork 12, the neck of the bottle 16 and onto the supporting flange 14. The jaws 52 and 54 are placed around the stopper 12 below the knob 62.

Figure 4:
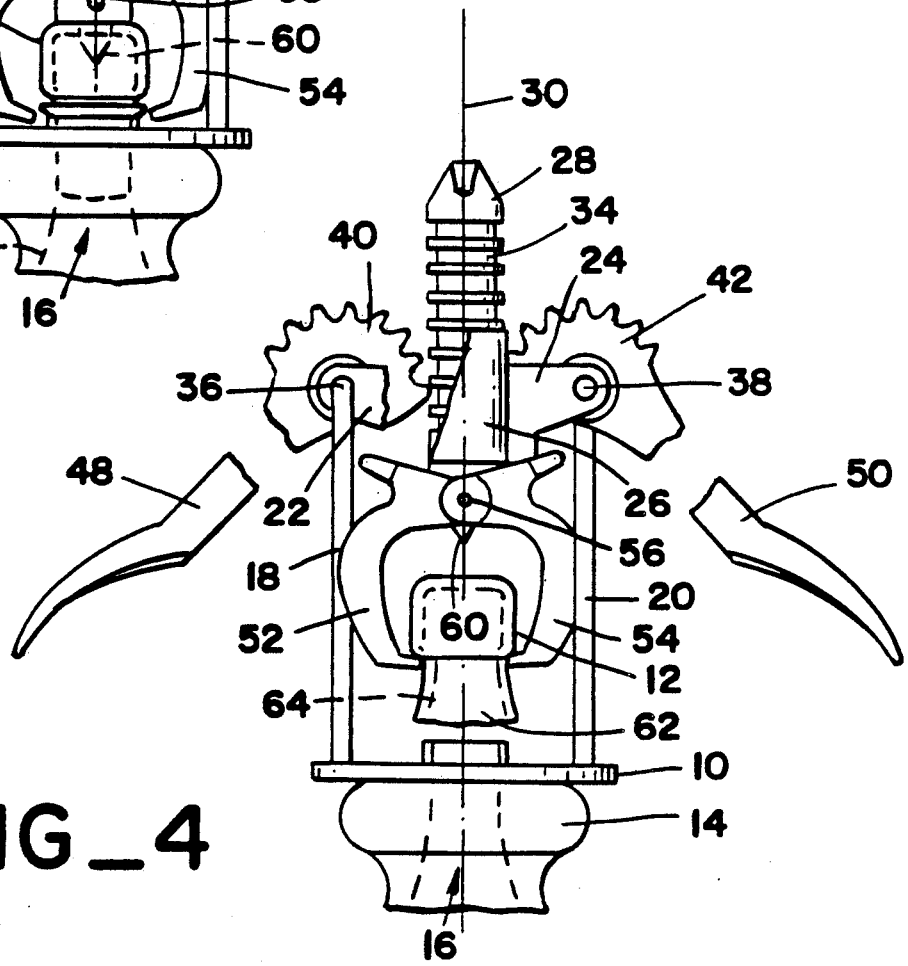
FIG. 4 is a profile view of the apparatus pulling a stopper.

If the stopper 12 is hollow, as shown by the dashed line 64 in FIG. 4, the user may desire first to relieve the gas in the bottle 16 before removing the stopper 12. The handles 48 and 50 are moved upward, forcing the operative shaft 28 downward. When the top of the slot 58 reaches the pivot 56, the pivot 56 is forced downward, and the jaws 52 and 54 are forced outward. The shaft 28 and the piercing pin 60 may continue downward until the jaws 52 and 54 reach their limit with the opening (not shown) at the top of the jaws abutting the shaft 28. At this time the tool 60 will have penetrated the hollow stopper. The jaws can move outward no farther, and the pivot and shaft 28 are prevented from moving farther downward.

The levers 48 and 50 are then moved downward, moving the shaft 28 and piercing pin upward and out of the stopper 12, releasing the trapped gas. Continued upward travel causes the pivot 56 to engage the bottom of the slot 58. Still farther upward travel of the shaft 28 pulls the pivot 56 upward, and the weight of the jaws 52, 54, acting through their center of gravity, close on the stopper under the knob 64. As shown in FIG. 4, continued downward movement of the levers 48 and 50, and upward movement of the shaft 28 and pivot 56 puts a pulling force between the bottle flange 14 and the stopper 12, and causes the jaws 52 and 54 to move upward to extract the stopper 12 from the bottle 16.

Thus, the apparatus of the invention slips easily onto a bottle and conveniently pierces the bottle stopper by moving the control levers in one direction. The stopper is pulled from the bottle by reversing the direction of travel of the levers. The convenience occurs because the slot in the operative shaft allows the piercing pin to be retracted far enough for the puller easily to be placed onto a bottle and stopper. The slot is also the facilitator in allowing extra travel of the piercing pin. The slot also allows the piercing pin to be withdrawn from the stopper before the stopper is pulled. It will be understood that where a solid cork is used, the penetrating tool is not utilized, since it is too short to extend through the cork and vent the bottle to atmosphere.

Although the invention has been described in detail above, the invention should not be limited by the expressed structure described but only according to the spirit and scope of the appended claims.

I claim:

1. Apparatus for piercing a stopper which is engaged in the neck of a bottle comprising:

support apparatus for placing over the neck of a bottle having a stopper therein;

an operative shaft reciprocally movable relative to said support apparatus to advance towards and retract away from said stopper;

a piercing pin attached to one end of said shaft and being directed toward the position occupied by said stopper when said support apparatus is abutted against said bottle, and pin having a straight shaft with a pointed tip thereon; and level operated means for selectively driving said shaft and said piercing pin toward and away from said position.

2. Apparatus for removing a stopper from a bottle comprising:

support apparatus for placing over the neck of a bottle having a stopper therein;

an operative shaft reciprocally movable relative to the position of said bottle stopper to advance towards and retract away from such position;

a piercing pin, attached to one end of said shaft and being directed towards said stopper position, for piercing a stopper by movement of said pin relative to such position;

a pair of stopper jaws having arcuate ends for embracing a stopper, pivoted upon a jaw pivot relative to each other, said jaw pivot being attached to move with said shaft, said jaw pivot being positioned so that pulling forces on said jaw pivot close said jaws against a stopper;

means forming an axially directed slot in the lower end of said shaft, said jaw pivot being positioned to slide in said slot; and lever operated means for driving said shaft and said piercing pin toward and away from said position.

3. Apparatus for extracting a stopper from a bottle comprising;

support apparatus for placing over the neck of a bottle having a stopper therein;

an operative shaft reciprocally movable relative to the position of a bottle stopper to advance toward and retract away from such position;

a pair of stopper jaws having arcuate ends for embracing a stopper, said arcuate ends having concave edges at the tips thereof which edges extend at right angles to said shaft, said stopper jaws being pivoted upon a jaw pivot and being pivotable relative to each other, said jaw pivot being attached to move with said shaft, said jaw pivot being positioned so that pulling forces on said jaw pivot close said jaws against a stopper; and lever operated means for driving said shaft, said jaw pivot and said jaws toward and away from said position.

4. Apparatus as recited in claim 3 and further comprising a piercing pin extending from said shaft and being directed towards said bottle stopper position, and means forming an axially directed slot in the lower end of said shaft, said jaw pivot being positioned to slide in said slot.

5. A combination stopper and stopper pulling apparatus comprising:

support apparatus for placing over the neck of a bottle having a stopper therein;

an operative shaft reciprocally movable relative to the position of a bottle stopper to advance toward and retract away from such position;

a piercing pin, attached to one end of said shaft, directed toward such stopper position, for piercing a stopper by movement of said piercing pin relative to such position;

a pair of stopper jaws having arcuate ends for embracing a stopper, pivoted upon a jaw pivot relative to each other, said jaw pivot being attached to move with said shaft, said pivot being positioned so that pulling forces on said pivot close said jaws against a stopper; and lever operated means, attached to drive said shaft, for translating said piercing pin, said jaw pivot, and said jaws toward and away from said position.

6. Apparatus as recited in claim 5 and further comprising means forming an axially directed slot in the lower end of said shaft, said jaw pivot being positioned to slide in said slot.

7. Apparatus as recited in claim 6 in which said slot is long enough to allow said piercing pin to clear a stopper held in said jaws.

8. Apparatus as recited in claim 7 in which said slot is short enough to stop the downward movement of said piercing pin before a stopper is damaged.

9. Apparatus as recited in claim 5 in which said jaws are prevented from opening beyond a predetermined open position.

10. Apparatus as recited in claim 9 in which said slot is short enough to allow said jaws completely to extract a stopper from a bottle.

11. In combination:

a base ring sized to fit over a bottle neck and a stopper which is engaged therein and to rest on a peripheral flange of such bottle neck:

an operative shaft with a rack gear on the periphery thereof and a piercing pin on the lower end thereof, said pin having a configuration which enables penetration of said pin through said stopper without rotation of said pin;

a sleeve surrounding and aligning said shaft and said piercing ring with the principal axis of said base ring, said sleeve having slots therein for receiving gears to mesh with said rack gear;

support means for supporting said sleeve from said base ring;

two segmented gears and levers, attached for rotation relative to said sleeve, positioned in said slots, and engaging said rack gear;

said base ring, support means, gears, levers, shaft, sleeve and piercing pin being dimensioned such that said ring may be placed against said flange when said levers are in a an intermediate position without penetration of said pin into said stopper, and piercing pin being positioned to penetrate such stopper when said levers are moved upward from said intermediate position.

12. Apparatus for extracting a stopper from a bottle comprising:

a base ring sized to fit over a bottle neck and to rest on a peripheral flange of such bottle neck;

an operative shaft with a rack gear on the periphery thereof and having a stopper piercing pin on one end that is directed towards said base ring;

a sleeve surrounding and aligning said operative shaft with the principal axis of said base ring, said sleeve having slots therein for receiving gears to mesh with said rack gear;

support means for supporting said sleeve from said base ring;

two segmented gears and levers, attached for rotation relative to said sleeve, positioned in said slots, and engaging said rack gear;

and two openable jaws, freely pivoted on a jaw pivot relative to each other, said pivot being positioned for limited movement in an axially directed slot formed in said operative shaft, the ends of said jaws being contoured to surround and grasp a beverage stopper;

said base ring, support means, gears, levers, operative shaft and sleeve being dimensioned so that said ring and jaws may be placed over a stopper when said levers are in an intermediate position, and said jaws grasp and extract said stopper when said levers are moved downward from said intermediate position.

13. Apparatus as recited in claim 12 in which the opening of said jaws is limited by mechanical interference between said jaws and said operative shaft.

14. Apparatus as recited in claim 12 in which said slot in said operative shaft is sufficiently short to allow said operative shaft to lift a stopper free from a bottle within the limits of travel of said operative shaft.

* * * * *